United States Patent [19]

Tanaka et al.

[11] Patent Number: 4,860,626

[45] Date of Patent: Aug. 29, 1989

[54] WIPPEN HEEL MECHANISM FOR AN UPRIGHT PIANO

[76] Inventors: Hajime Tanaka, 855-20 Ooaza Shimogo, Ogoori-cho, Yosiki-gun, Yamaguchi; Shiro Saito, 25-23 Ebizuka 2-chome, Hamamatsu-shi, Shizuoka, both of Japan

[21] Appl. No.: 93,708

[22] Filed: Sep. 8, 1987

[30] Foreign Application Priority Data

Sep. 9, 1986 [JP] Japan ..... 61-138348[U]
Sep. 9, 1986 [JP] Japan ..... 61-138349[U]
Sep. 9, 1986 [JP] Japan ..... 61-212427

[51] Int. Cl.[4] ..... G10C 3/18

[52] U.S. Cl. ..... 84/236; 84/239; 84/240

[58] Field of Search ..... 84/236, 240, 237, 239, 84/243

[56] References Cited

U.S. PATENT DOCUMENTS

| | | | |
|---|---|---|---|
| 896,763 | 8/1908 | Schimmel | 84/239 |
| 900,308 | 10/1908 | Perry | 84/236 |
| 1,586,547 | 6/1926 | Eastwood | 84/240 |

FOREIGN PATENT DOCUMENTS

| | | |
|---|---|---|
| 74725 | 9/1892 | Fed. Rep. of Germany . |
| 73461 | 2/1893 | Fed. Rep. of Germany . |
| 2155211 | 5/1973 | Fed. Rep. of Germany . |
| 58-108496 | 7/1983 | Japan . |
| 226616 | 1/1925 | United Kingdom . |
| 332328 | 7/1930 | United Kingdom . |

*Primary Examiner*—L. T. Hix
*Assistant Examiner*—Brian W. Brown
*Attorney, Agent, or Firm*—Wenderoth, Lind & Ponack

[57] ABSTRACT

An improved wippen heel arrangement for an upright piano includes: a pillar screwed into one end portion of a piano key so that the projecting length of the pillar which projects from the piano key is adjustable; a wippen heel attached to a wippen constituting one element of an action mechanism; and a wippen joint interposed between the pillar and the wippen heel for pivotal movement about a stationary shaft, in which the thrust applied to the pillar is transmitted through the wippen joint to the wippen. Accordingly, a key touch quality which may be experienced with a grand piano can be enjoyed using an upright piano.

7 Claims, 5 Drawing Sheets

WIPPEN HEEL MECHANISM FOR AN UPRIGHT PIANO

BACKGROUND OF THE INVENTION

The present invention relates to an improvement in a wippen heel mechanism for an upright piano.

Upright pianos have heretofore been widely used becasue of their reduced size, inexpensive price and convenient operability. However, there is merit to the proposition that upright pianos are inferior to grand pianos in terms of tone volume, key touch quality, and the operation of each action mechanism for causing movement of a hammer.

For this reason, upright pianos is seldom employed for public performance such as concerts; accordingly, it is known that even a student who practices while playing an upright piano eventually employs a grand piano for practice.

Referring to FIG. 5 in which like reference numerals are used to denote like or corresponding elements shown in FIGS. 1 and 2, a conventional type of upright piano includes a known action mechanism which is arranged to transmit the motion of each piano key K to a hammer H. However, comparing such an action mechanism 7 is to the improved action mechanism 7 shown in FIG. 1 which will be described later, the wippen heel arrangement of the mechanism 7 assumes an undesirable state shown in FIG. 3. This may causes various difficulties in the assembly of a piano, and there is a risk of adversely affecting the key touch quality of a depressed key.

In general, the aforesaid action mechanism 7 functions to transmit the motion of the piano key K to the hammer H, and the wippen heel arrangement serves as an input portion for the mechanism 7. As shown in FIG. 3, in accordance with the related art, the wippen heel arrangement has a pillar 9 screwed into a piano key K for allowing the length of the projecting portion of the pillar 9 which projects from the piano key to be adjusted and a wippen heel 11 disposed in contact with the upper surface of the pillar 9. The upper surface of the pillar 9 is semispherical while the lower surface of the wippen heel 11 is substantially flat. In this arrangement, the wippen heel 11 is adapted to be moved up and down positively in accordance with any motion of the piano key K.

In such a wippen heel arrangement, however as shown in FIG. 3, the circular arc traced by the upper end of the pillar 9 intersects that traced by the lower end of the wippen heel 11 at a large angle. The higher a piano the larger, this angle of intersection becomes.

For this reason, when the piano key K is depressed, slip may take place between the pillar 9 and the wippen heel 11. Specifically, after the depression of the piano key K, a contact point a between the pillar 9 and the wippen heel 11 is caused to travel towards a point b away from a point a' at the end of upward movement of the pillar 9.

If such slip causes any unnecessary motion in the mechanism, the key touch quality of a piano becomes unsatisfactory and, in addition, there is a likelihood that a felt cover bonded to the wippen heel 11 may be damaged in a short period of time.

As shown in FIG. 4, a counterpillar 11*a* may be attached to the lower end of the wippen heel 11, and the lower surface of the counterpillar 11*a* may be provided with a concave surface complimentary to the shape of the upper surface of the pillar 9. However, this arrangement has a disadvantage in that it is difficult to attach a felt cover to such a concave surface. In particular, it is extremely difficult to attach all the felt pads to the same concave surface. Moreover, in such an arrangement, the contact point a between the pillar 9 and the counter pillar 11*a* is caused to travel to an upwardly right point a' about the rotational center e of the piano key K. Simultaneously, a continuous point b between the wippen heel 11 and the counter pillar 11*a* is caused to travel to an upwarly left point b' about the rotational center f of the wippen 12.

Accordingly, the force applied to the upper end of the pillar 9 is dispersed in the direction of C (shown in broken line) to D (shown in broken line) and thus the counterpillar 11*a* is forced in an inclined upward direction. This may produce the unnecessary motion and a pinch of the wippen heel arrangement, thus making it impossible to catch the hammer H.

SUMMARY OF THE INVENTION

It is therefore an object of the present present invention to provide a wippen heel arrangement for an upright piano in which it is possible to enjoy a key touch quality similar to that experienced with a grand piano and yet which can be easily assembled and substantially suffers neither damage nor abrasion.

The aforesaid object is achieved by the present invention which provides a wippen heel arrangement comprising; a pillar screwed into one end portion of a piano key for adjustment of the projecting length of pillar which projects from the piano key; a wippen heel attached to a wippen constituting one element of an action mechanism; and a wippen joint interposed between the pillar and the wippen heel for pivotal movement about a stationary shaft, wherein said stationary shaft is positioned so that the initial contact portion of said pillar at which said pillar initially contacts said wippen joint travels in a circular arc having a first radius while the initial contact portion of said wippen joint at which said wippen joint initially contacts said pillar travels in a circular arc having a second radius centered about said stationary shaft, said respective circular arcs with such first and second radii being so defined relative to each other so as to effect a substantially straight orbit travelled by the actual contact point between said pillar and said wippen joint.

In accordance with the present invention, the pillar and the wippen are brought into contact with each other with the wippen joint interposed therebetween, and transmission of the thrust is effected while the wippen joint is absorbing the relative shift between the pillar and the wippen in relation to the direction of transmission of the thrust. It is thus possible to prevent the wippen heel arrangement from being damaged or dislocated. Even if the wippen heel arrangement suffers any damage, it can be easily repaired. In addition, a key touch quality which may be experienced with a grand piano can be enjoyed using an upright piano.

Further objects, features and advantages of the present invention will become apparent from the following description of a preferred embodiment of the present invention with reference to the accompanying drawings.

DETAILED DESCRIPTION OF THE PREFERRED EMBODIMENT

Figure 1:
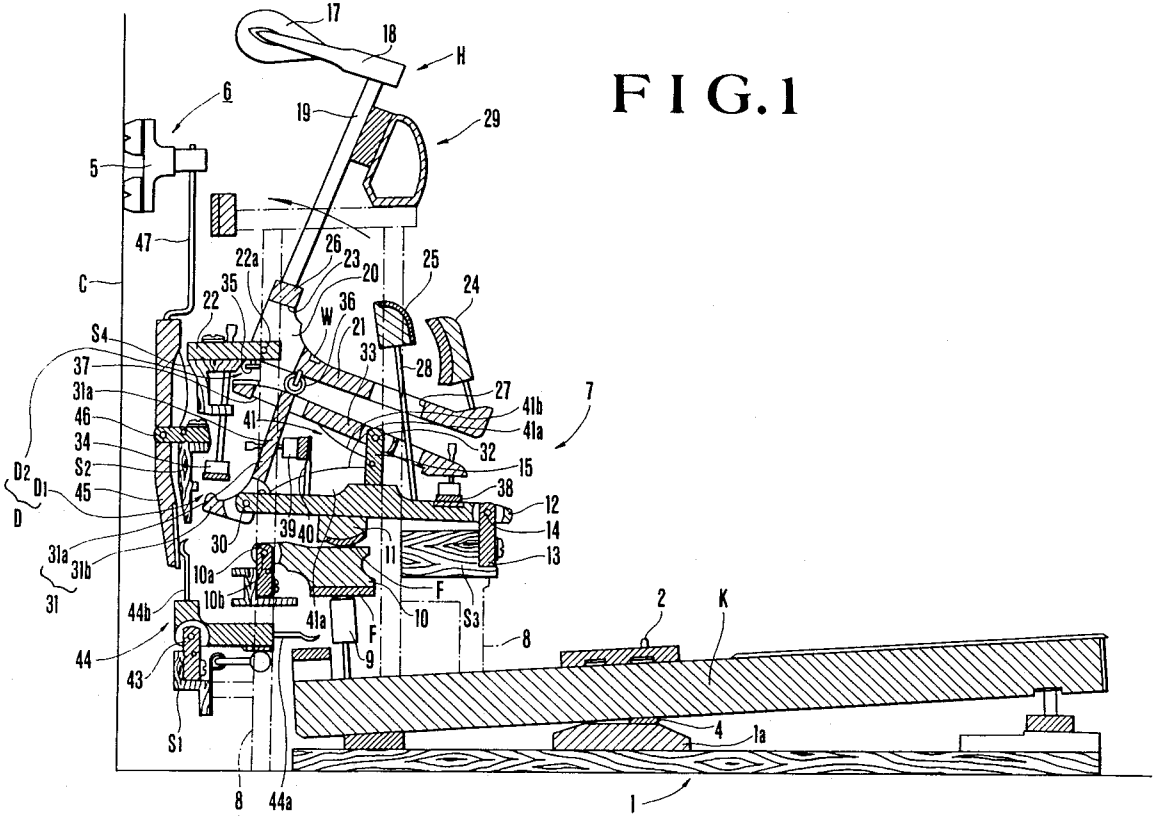
FIG. 1 is a diagrammatic, cross-sectional view of a preferred embodiment of the present invention.

A preferred embodiment of the present invention will be described below with reference to the accompanying drawings in which like reference numerals are used to identify identical elements throughout the several views.

Referring first to FIG. 1, a plurality of piano keys K are arranged on a keyboard, and each of the piano keys K are supported on a keyframe 1 fixed to a key bed (not shown). The piano key K is attached to a central key from 1*a* on the key frame 1 for facilitating a swinging motion of the key K about a pin 2.

It is to be noted that a felt pad 4 is provided on the lower surface of the piano key K which faces the central key frame 1*a*.

In the present preferred embodiment, the depressing force applied to the piano key K is transmitted to first and second mechanisms. The first mechanism is a damper mechanism 6 including a damper 5 which is adapted to be pressed against a string C provided for damping purposes, the mechanism arranged to bring the damper 5 into and out of contact with the string C. The second mechanism is an action mechanism 7 arranged to cause a hammer H to strike the string C.

The aforesaid damper mechanism 6 is supported by support frames $S_1$ and $S_2$ which are attached to a fixed frame 8 (shown in one-dot chain line in FIG. 1) while the action mechanism 7 is supported by support frames $S_3$ and $S_4$ which are attached to the same fixed frame 8.

In this manner, the damper mechanism 6 and the action mechanism 7 are separately supported by the support frames $S_2$ and $S_4$. With this arrangement, the tone produced by the string C when struck by the hammer H can be easily damped by means of a damper pedal.

In general, in a typical piano a tone is produced by striking three strings at the same time and, in order to produce a damped tone, only two of the three are struck by the hammer H. In the latter case in which the hammer H strikes two of the three strings, the associated action mechanism 7 is commonly displaced laterally in a parallel relationship with the three strings. This lateral displacement of the action mechanism 7 is relatively easily realized by the separate arrangement of the damper mechanism 6 and the action mechanism 7. For this reason, the damper mechanism 6 is supported by the support frames $S_1$ and $S_2$ which are disposed separately from the support frame $S_3$ that provides support for the action mechanism 7.

First, the action mechanism 7 will be described below. The action mechanism 7 includes a pillar 9 adjustably bolted to each of the piano keys K and is arranged to transmit thrust to the hammer H, thereby causing the hammer H to effect a predetermined striking operation. The thrust exerted by the pillar 9 is transmitted to the wippen heel 11 through a wippen joint 10 which will be described later.

Figure 2:
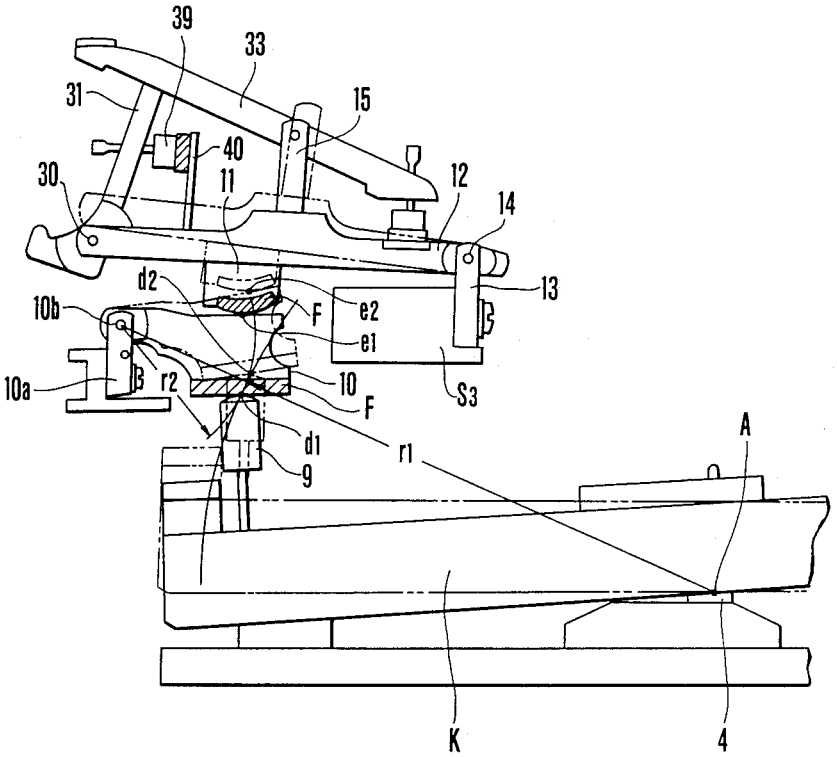
FIG. 2 is an enlarged, cross-sectional view of the essential portion of the embodiment shown in FIG. 1.
Figure 3:
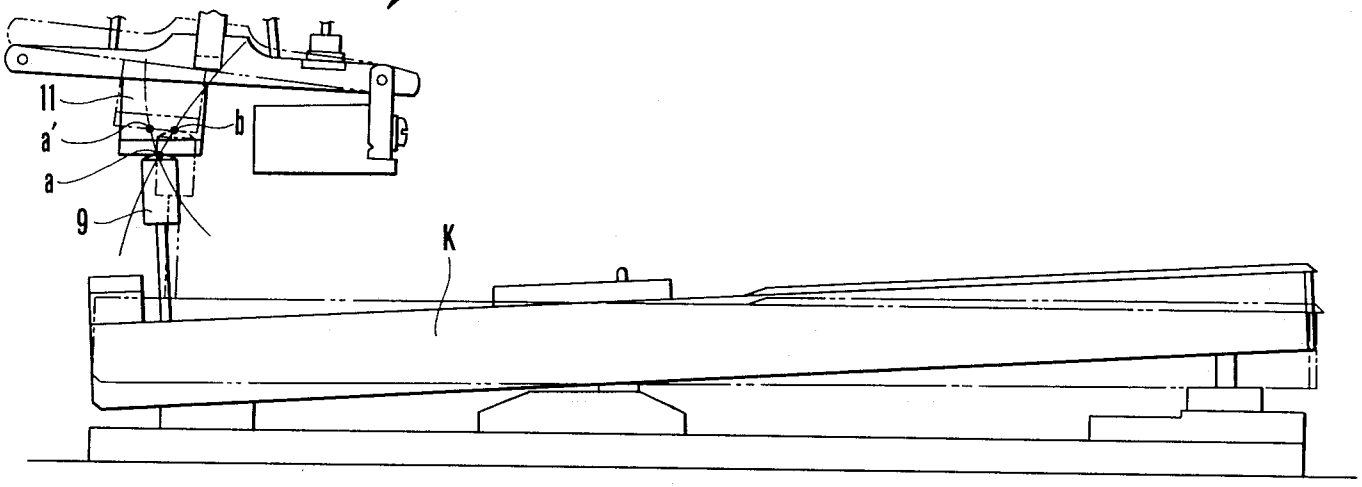
FIG.3 (PRIOR ART)
FIGS. 3 and 4 are respectively diagrammatic, cross-sectional views of the essential portion of a conventional type of upright piano.
Figure 4:
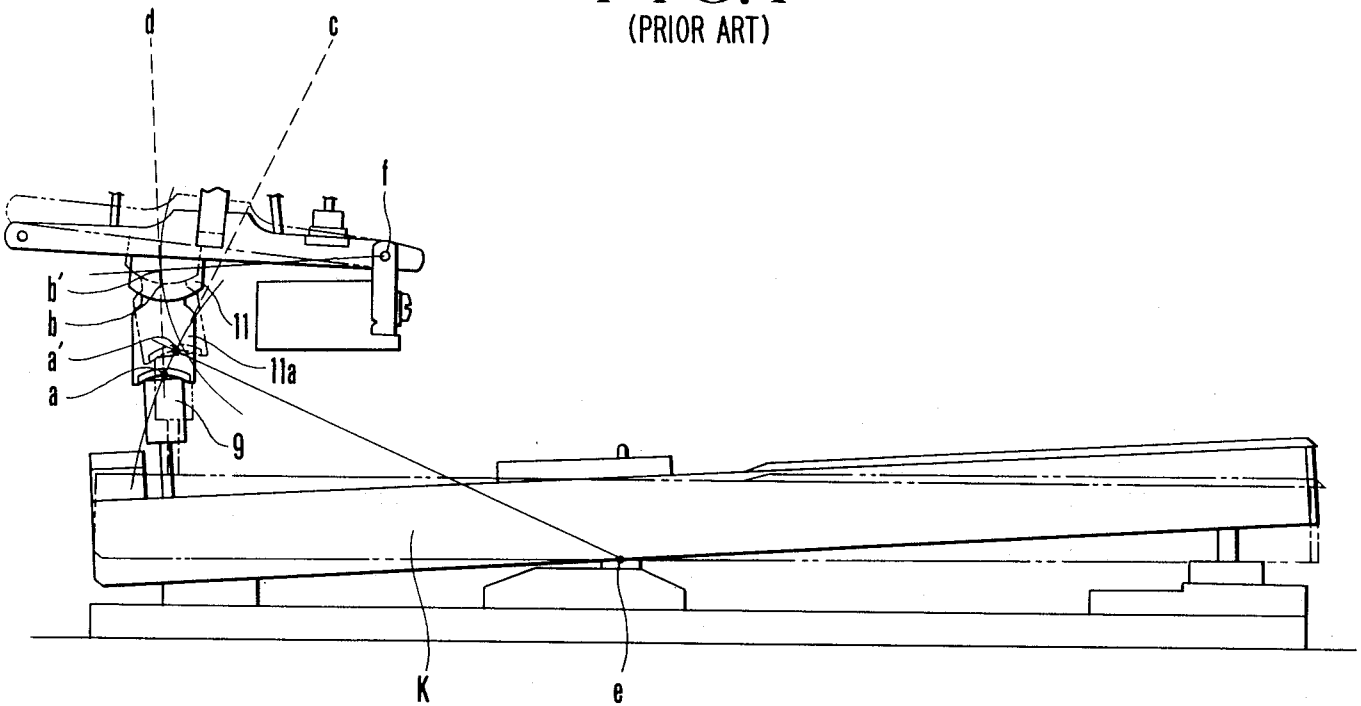
FIG.4 (PRIOR ART)
Figure 5:
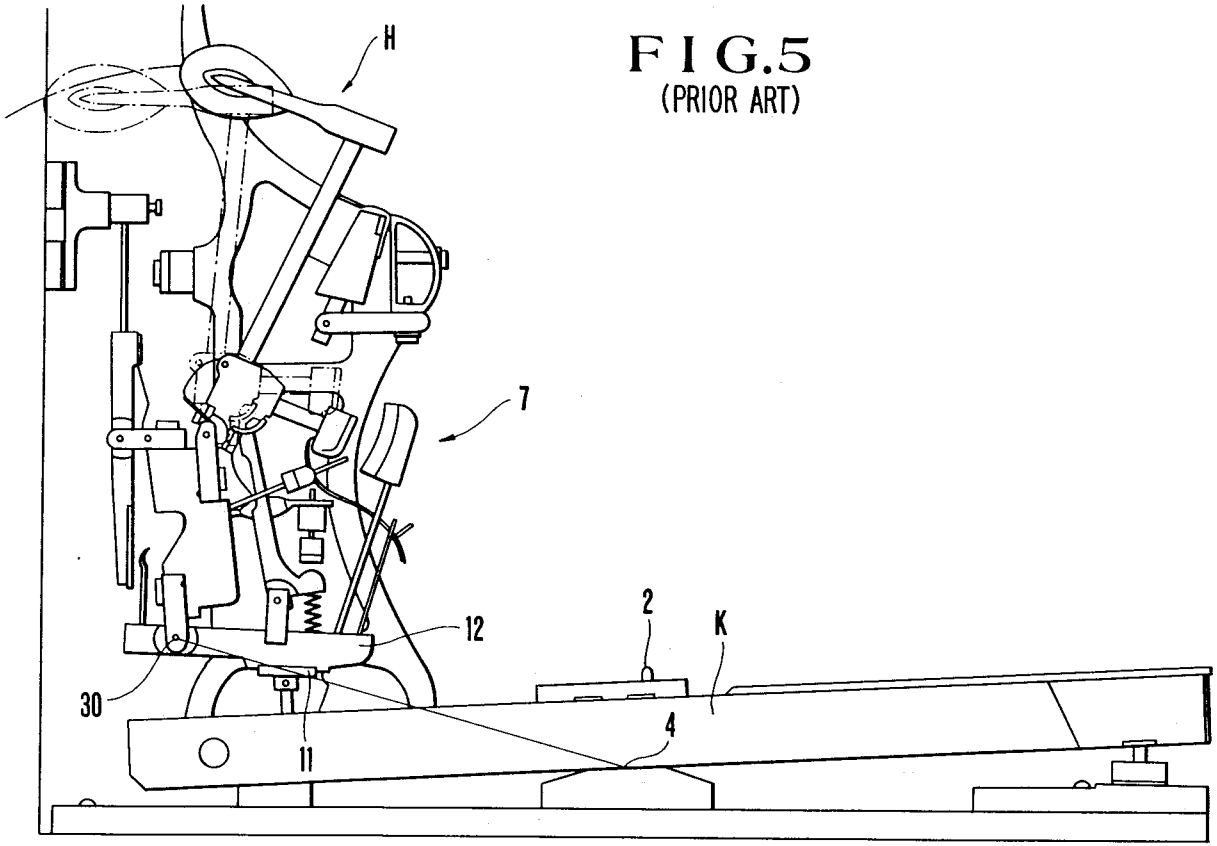
FIG.5 (PRIOR ART)
FIG. 5 is a diagrammatic, cross-sectional view of another wippen heel arrangement of a conventional type of upright piano.

In particular, in the present preferred embodiment, as shown in FIGS. 1 and 2, the upper surface of the pillar 9 is semispherical and the lower surface of the wippen joint 10 is flat, with a felt pad F bonded to the lower surface of the latter. The wippen heel 11 attached to the wippen 12 has a semispherical lower surface and the upper surface of the wippen joint 10 is flat, with another felt pad F bonded to the lower surface of the wippen heel 11.

A joint support 10*a* having a stationary shaft 10*b* is attached to the fixed frame 8, and the aforesaid wippen joint 10 is pivotably supported by the stationary shaft 10*b*.

Accordingly, the thrust exerted by the pillar 9 is transmitted to the wippen heel 11 through the wippen joint 10.

As shown more specifically in FIG. 2, an initial contact portion of the pillar 9 at the surface of the wippen joint 10 is moved in a circle having a radius $r_1$ about point A on a pad 4. Furthermore, on initial contact point at between the pillar 9 of the lower surface of the wippen joint 10 is moved in a circle having a radius $r_2$. The stationary shaft 10*b* is positioned such that the geometry of the respective circular arcs having radii $r_1$ and $r_2$ effects a substantially straight path travelled by the actual contact point $d_1$ of the pillar 9 and the wippen joint 10 extending to $d_2$.

Accordingly, each of the circular arcs having radii $r_1$ and $r_2$ is substantially tangential to or has a tangent parallel to the straight line extending between the actual contact points $d_1$ and $d_2$. Thus, the pillar 9 and the wippen joint 10 can move without any slip occurring therebetween.

A contact point $e_1$ between the upper surface of the wippen joint 10 and the wippen heel 11 is caused to travel toward a point $e_2$ located in the circular arc centered about the stationary shaft 10*b*. This travel is achieved without any slip occurring in the same manner as just described.

Accordingly, the travel of these contact points is accomplished without any slip on the upper and lower surfaces of the wippen joint 10. It is therefore possible to extremely reduce the friction between the pillar 9 and the wippen joint 10 as well as between the wippen joint 10 and the wippen heel 11, and this prevents damage of each of the felt pads F which are provided therebetween.

As compared with the prior art arrangement, this improved arrangement enables the depressing force applied to the piano key K by a finger to be positively transmitted from the pillar 9 through the wippen joint 10 to the wippen 12 without affecting a dimensional balance, thereby enabling exact catching. In addition, this arrangement eliminates the uncomfortableness of a key touch quality, and it is thus possible to enjoy a key touch quality further resembling that which may be experienced with a grand piano.

The wippen heel 11 is attached at its upper surface to the wippen 12 as one constituent element of the double escapement mechanism D will be described later. As shown, the right-hand end of the wippen 12 is pivotally supported by a shaft 14 attached to a wippen fork 13 which projects from the support frame $S_3$ in the upward direction as viewed in FIG. 1. A repetition lever fork 15 is fixed substantially upright to the substantially lengthwise mid portion of the wippen 12 which is positioned to the right of the wippen heel 11. The repetition lever fork 15 constitutes one part of the double escapement mechanism D.

The following is a description of the hammer H, and the double escapement mechanism D will be described in detail later.

Referring to FIG. 1, the hammer H is substantially L-shaped and includes an upright arm 19 having one end provided with a hammer felt pad 17 and a hammer wood 18; and a horizontal arm 21 connected via a boss portion 20 to the other end of the upright arm 19. The boss portion 20 is pivotally supported by a shaft 22*a* attached to a fixed bracket 22 which projects from the support frame $S_4$ to the right as viewed in FIG. 1.

The aforesaid boss portion 20 includes a through-hole 23, and the projecting end of the fixed bracket 22 extends into the through-hole 23.

The aforesaid horizontal arm 21 has a back check 24 at its terminal end (the right-hand end as viewed in FIG. 1). The back check 24 is adapted to come into contact with a hammer check 25 when the hammer H is reactively returned clockwise after it has struck the string C. The hammer check 25 is attached to one end of a resilient wire 28 which is connected at the other end to the wippen 12 in an upright manner. The resilient wire 28 extends through a through-hole 27 which is formed in the horizontal arm 21. The hammer check 25 is adapted to limit the motion of the back check 24 utilizing the resiliency of the resilient wire 28.

Incidentally, a hammer stopper 29 is disposed on the top of the fixed frame 8*b*, and the balance of the hammer H may be adjusted by disposing a balance weight W at a predetermined position located along the horizontal arm 21.

The double escapement mechanism D includes a first lever 31 and a second lever 33. The first lever 31 is pivotably supported by a shaft 30 attached to the end of the wippen 12 adjacent to the string C while the second lever 33 is pivotably supported by a shaft 32 attached to the upper end of the repetition lever fork 15 which is uprightly disposed on the wippen 12. The movement of the first lever 31 is limited by a first stopper 34 while the movement of the second lever 33 is limited by the aforementioned second stopper 35.

In particular, the first lever 31 is commonly called a jack, and includes a first jack 31*a* and a second jack 31*b*. The first jack 31*a* is adapted to strike a hammer roller 36 attached to the underside of the horizontal arm 21 which provides support for the hammer H. The second jack 31*b* is integral with the first jack 31*a*, and is adapted to abut the first stopper 34 to shift the first jack 31*a* from the position which allows the jack 31*a* to strike the hammer roller 36, thereby preventing the jack 31*a* from striking the hammer roller 36.

The first stopper 34 is attached to one end of a regulating screw 34*a* which extends through the fixed bracket 22 and the fixed frame $S_4$. Adjustment of the first stopper 34 is performed merely by rotating the screw 34*a* from above, by means of a screwdriver or the like.

The second lever 33 is commonly called a repetition lever, and includes a through hole 37 at a left-hand portion thereof as viewed in FIG. 1, with one end of the first jack 31*a* extending through the through-hole 37. The second lever 33 further includes an adjustment screw 38 at a right-hand portion thereof as viewed in FIG. 1. The adjustment screw 38 serves to adjust the inclination of the repetition lever (the second lever 33) with respect to the wippen 12, and the lower end of the adjustment screw 38 is normally maintained in contact with the wippen 12.

It is to be noted that an adjustment screw 39 is attached to the lengthwise mid portion of the first jack 31*a*. The inclination of the first lever 31 with respect to the wippen 12 is adjusted by adjusting the length of the projectng portion of the adjustment screw 39 that projects from the first jack 31*a* to alter the distance between the first lever 31 and a stopper 40 which projects upwardly from the wippen 12.

A leaf spring 41 is disposed between the first and second levers 31 and 33, and the folded mid portion of the leaf spring 41 is attached to the aforesaid repetition lever fork 15. The leaf spring 41 has a long leg 41*a* and a short leg 41*b*. One end of the long leg 41*a* is engaged with the first lever 31 in the vicinity of the shaft 30 which pivotably supports the first lever 31, and thus urges the first lever 31 about the shaft 30 in a counterclockwise direction. One end of the short leg 41*b* is attached to the second lever 33, and thus urges the second lever 33 about the shaft 32 in a clockwise direction.

More specifically, the double escapement mechanism D includes a first escapement mechanism $D_1$ and a second escapement mechanism $D_2$. The first escapement mechanism $D_1$ functions to allow escapement of the pressure which the first jack 31*a* of the first lever 31 applies to the hammer roller 36. The second escapement mechanism $D_2$ functions to allow initial escapement of pressure acting upon the hammer H during the clockwise angular displacement of the wippen 12, that is, while the wippen 12 is rotated clockwise. The first escapement mechanism $D_1$ includes the second jack 31*b*, the first stopper 34, the first jack 31*a* and the aforesaid through-hole 37 formed in the second lever 33 while the second escapement mechanism $D_2$ includes the second lever 33 and the second stopper 35. After the first and second escapement mechanisms $D_1$ and $D_2$ have completed the aforesaid escapement of pressure, even if the piano key K is not returned to its original position, i.e., the position shown in FIG. 1, the second lever 33 and the first jack 31*a* are urged under the resilient force of the leaf spring 41 to return to the position which allows the jack 31*a* to strike the hammer roller 36.

The damper mechanism 6 includes a toggle mechanism 44 which has an actuating piece 44*a* and a pressing piece 44*b* and which is pivotally supported by a bracket 43 attached to the support frame $S_1$. The depressing force applied to the piano key K is transmitted to the lower end of a damper 45 through the actuating piece 44*a* and the pressing piece 44*b*. A damper lever fork 46 is attached to the support frame $S_2$ so as to project therefrom in the direction opposite to the string C, and such a damper lever 45 is pivotably attached to the damper lever fork 46. When the lower end of the damper lever 45 is pressed by the pressing piece 44*b* of the toggle mechanism 44, the damper 5 is released from the string C by the action of a resilient wire 47 attached to the upper end of the damper lever 45.

The following is a description of the operation of the present preferred embodiment of the invention with specific reference to FIGS. 1 and 2.

Referring again to FIG. 1 illustrating the piano key K in its rest position, when the piano key K is depressed in this state, the pillar 9 is moved upwardly to cause angular displacement of the wippen 12 about the shaft 14 through the intermediary of the wippen joint 10 and the wippen heel 11, thereby causing the first and second levers 31 and 33 to rotate in the clockwise direction.

In this case, although the pillar 9 is moved in a circle having a radius $r_1$ about the pin 2, the wippen joint 10 is arranged to transmit the motion of the pillar 9 to the wippen heel 11 without involving any deviation therebetween. Accordingly, the wippen joint 10 can be moved in accordance with the motion of the pillar 9 to smoothly and positively transmit to the wippen 12 the vertical motion of the pillar 9.

Since the hammer roller 36 abuts the first and second levers 31 and 33, the horizontal arm 21 carrying the hammer H is moved counterclockwise to cause the hammer H to travel toward the string C as shown in FIG. 2.

It is to be noted that, since the aforesaid pillar 9 is screwed into the piano key K, adjustment of the pillar 9 is extremely easy.

Since many changes and different embodiments of this invention can be made without departing from the scope thereof, it is intended that all matter contained in the drawings and specification should be interpreted illustratively and not in a limited sense.

What is claimed is:

1. A wippen heel mechanism of an upright piano for transmitting thrust between a piano key and a hammer of the piano, said mechanism comprising:

a piano key pivotally mounted in the piano about a fulcrum point between normal and depressed positions;

a pillar projecting from and threadingly engaged with the piano key in a manner in which the extent to which the pillar projects from the piano key is adjustable;

a wippen operatively connected between the piano key and a hammer for transmitting thrust from the piano key to the hammer when the piano key is depressed;

a wippen heel attached to said wippen, said wippen heel having a lower surface that is semispherical;

a stationary shaft spaced from said wippen heel, said shaft having a longitudinal axis and mounted in the piano with said longitudinal axis immovably fixed in the piano;

a wippen joint pivotally mounted in the piano via said stationary shaft about the longitudinal axis thereof, said wippen joint extending between said pillar and said wippen heel, contacting said pillar at an initial contact point when the piano key is in said normal position, and having an upper flat surface contacting the lower surface of said wippen heel, said wippen joint pivoting between first and second positions via said pillar as the piano key is moved from said normal to said depressed position; and said stationary shaft, the initial point of contact between said wippen heel and said pillar, and said fulcrum point defined relative to one another in the piano so as to establish an operating relationship between said wippen jont and said pillar in which the point of contact therebetween travels in a substantially straight line as said piano key is depressed from said normal position to said depressed position and said wippen joint is pivoted about the longitudinal axis of said stationary shaft by said pillar without slip occurring between said wippen joint and said pillar.

2. A wippen heel mechanism as claimed in claim 1, and further comprising a joint support fixed in the piano, said stationary shaft supported by said joint support.

3. A wippen heel mechanism as claimed in claim 1, wherein said pillar has an upper surface that is semispherical, and said wippen joint has a lower surface that is flat and contacts the upper surface of said pillar.

4. A wippen heel mechanism as claimed in claim 3, wherein said wippen joint includes a felt pad defining the lower surface thereof.

5. A wippen heel mechanism as claimed in claim 1, wherein said wippen heel includes a felt pad defining the lower surface thereof.

6. A wippen heel mechanism of an upright piano for transmitting thrust between a piano key and a hammer of the piano, said mechanism comprising:

a piano key pivotally mounted in the piano about a fulcrum point between normal and depressed positions;

a pillar projecting from and threadingly engaged with the piano key in a manner in which the extent to which the pillar projects from the piano key is adjustable;

a wippen operatively connected between the piano key and a hammer for transmitting thrust from the piano key to the hammer when the piano key is depressed;

a wippen heel attached to said wippen, said wippen heel having a lower surface that is semispherical;

a stationary shaft spaced from said wippen heel, said shaft having a longitudinal axis and mounted in the piano with said longitudinal axis immovably fixed in the piano;

a wippen joint pivotally mounted in the piano via said stationary shaft about the longitudinal axis thereof, said wippen joint extending between said pillar and said wippen heel, contacting said pillar at an initial contact point when the piano key is in said normal position, and having an upper flat surface contacting the lower surface of said wippen heel, said wippen joint pivoting between first and second positions via said pillar as the piano key is moved from said normal to said depressed position; and a portion of the pillar that initially contacts said wippen joint when the piano key is in said normal position traveling in an arcuate path having a radius of curvature centered at said fulcrum point as the piano key is depressed to said depressed position, a portion of the wippen joint that initially contacts said pillar when the piano key is in said normal position traveling in an arcuate path having a radius of curvature centered at the longitudinal axis of said stationary shaft, said radii of curvature defined relative to one another in such a manner that the actual contact point between said pillar and said wippen joint travels in a substantially straight path as the piano key is moved between said normal and said depressed positions without slip occurring between said wippen joint and said pillar.

7. A wippen heel mechanism as claimed in claim 6, wherein said arcuate paths each extend tangentially to said straight path along which the actual contact point travels.

* * * * *